US005160964A

United States Patent [19]

Takahashi et al.

[11] Patent Number: 5,160,964

[45] Date of Patent: Nov. 3, 1992

[54] IMAGE RECORDING APPARATUS OCCUPYING A MINIMUM AMOUNT OF SPACE

[75] Inventors: Hideki Takahashi, Moriguchi; Shigemitsu Tani, Hirakata; Akira Fukano, Katano; Kazuto Katakura, Suginami; Hitoshi Makimoto, Ichikawa; Yoshikazu Watanabe, Tanashi, all of Japan

[73] Assignee: Matsushita Electric Industrial Co., Ltd., Osaka, Japan

[21] Appl. No.: 722,677

[22] Filed: Jun. 28, 1991

[51] Int. Cl.[5] ..... G03G 15/00

[52] U.S. Cl. ..... 355/200; 355/211; 355/245

[58] Field of Search ..... 355/200, 210, 211, 245, 355/219; 271/121, 124; 358/480; 346/160

[56] References Cited

U.S. PATENT DOCUMENTS

| | | | |
|---|---|---|---|
| 4,342,050 | 7/1982 | Traino | 358/480 X |
| 4,371,252 | 2/1983 | Uchida et al. | 355/219 |
| 4,414,583 | 11/1983 | Hooker, III | 358/480 X |
| 4,754,293 | 6/1988 | Aizawa et al. | 355/309 X |
| 4,835,568 | 5/1989 | Howard et al. | 355/219 |
| 4,912,563 | 3/1990 | Narita | 355/200 X |
| 4,924,267 | 5/1990 | Yoshikawa et al. | 355/210 |
| 4,928,129 | 5/1990 | Honda | 346/160 |
| 4,941,002 | 7/1990 | Maruyama et al. | 346/160 |
| 4,952,974 | 8/1990 | Mori | 355/200 |
| 4,958,826 | 9/1990 | Chen | 271/124 |
| 4,985,731 | 1/1991 | Sakakura et al. | 355/210 |
| 5,021,825 | 6/1991 | Niki | 355/200 |
| 5,079,593 | 1/1992 | Satoh et al. | 355/210 X |

FOREIGN PATENT DOCUMENTS

| | | |
|---|---|---|
| 2-62509 | 5/1990 | Japan . |
| 2-272470 | 11/1990 | Japan . |
| 3-33761 | 2/1991 | Japan . |

*Primary Examiner*—A. T. Grimley
*Assistant Examiner*—Robert Beatty
*Attorney, Agent, or Firm*—Wenderoth, Lind & Ponack

[57] ABSTRACT

An image recording apparatus has a paper feeding system, a process unit for performing an electrophotographic process, a fixing system, an optical system, and a delivery system. The process unit is detachable from a main body through a front cover. The front cover has a container attached to its inner surface. The process unit can be divided into two parts which are separable from each other: a first part including a developer and a toner cartridge, and a second part including a photosensitive drum, a charger, a transferrer, and a cleaner. The paper feeding system is disposed on an upper portion of a main body of the image recording apparatus. The process unit and the fixing system are positioned diagonally below and forward of the paper feeding system such that a paper path connecting the paper feeding system and the fixing system descends forward. The optical system is disposed in a lower portion of the main body in such a manner as to partially underlie the process unit.

18 Claims, 17 Drawing Sheets

IMAGE RECORDING APPARATUS OCCUPYING A MINIMUM AMOUNT OF SPACE

BACKGROUND OF THE INVENTION

1. Field of the Invention

The present invention relates to a compact and easily maintainable image recording apparatus using an electrophotographic technique.

2. Description of the Prior Art

Recording apparatuses are widely used in various fields, particularly in the field of the so-called "office automation", and are now required to offer a good quality of printing performance and finely recorded images. An image recording apparatus of a type using laser beams has been developed to meet such a requirement and the use thereof is now spreading. FIG. 19 shows such an image recording apparatus.

In FIG. 19, a reference number 1 generally indicates the image recording apparatus. There are provided a paper feeding system 2, a process system 3 for performing an electrophotographic process, a fixing system 4 and an optical system 5 in a main body 1*a* of the apparatus 1. The paper feeding, system 2 takes up paper sheets 7 stacked on a paper tray 6 one by one and conveys the sheet 7 taken up to the process system 3. The process system 3 includes a photosensitive drum 8, two chargers 9 and 10, a developer 11 and a cleaner 12. In the process system 3, the charger 9 provides the photosensitive drum 8 with negative charges and laser beams coming from the optical system 5 form an electrostatic latent image on the photosensitive drum 8. The developer 11 has a magnetic roller 15 to which toner 14 fed from a toner casing 16 adheres. The toner 14 on the magnetic roller 15 is attracted to the photosensitive drum 8, the electrostatic latent image thereby developing. The sheet 7 conveyed to the process system 3 is provided with positive charges by the charger 10 and then the toner 14 adhering to the photosensitive drum 8 are transferred to the sheet 7.

After the toner 14 is transferred to the sheet 7, and residual toner 14 is removed from the photosensitive drum 8 by the cleaner 12. The cleaner 12 has a silicon rubber plate 17 to contact the photosensitive drum 8 along the width direction. This silicon rubber plate 17 scrapes the residual toner 14 from the photosensitive drum 8. The scraped toner 14 is gathered in a used-toner casing 18.

The sheet 7 with the toner 14 is sent to the fixing system 4, where the toner 14 is thermally fixed. Thereafter, the sheet 7 is discharged to a delivery tray.

The photosensitive drum 8, charger 9, developer 11, cleaner 12, toner casing 16 and used-toner casing 18 are integrated in a housing, formed of resin or other materials as a "process unit 20" which is replaceable when the toner 14 in the toner casing 16 has run short. This makes maintenance operations, which are generally complicated and troublesome, as simple as possible.

By the way, compactness or size reduction is generally required in various kinds of apparatuses. This permits economic use of space in offices or other places for installation of the apparatuses. The above conventional image recording apparatus 1 is, however, structurally difficult to make compact for the following reasons.

In the image recording apparatus 1, a total occupied area in a paper conveyance direction of the paper feeding system 2, the process system 3, and the fixing system 4 establishes the installation size of the image recording apparatus 1, more specifically, of the main body 1*a*. Although the image recording apparatus 1 can be theoretically made smaller by decreasing the area occupied by the respective systems, there is a limit in reducing the size of each system and, as a matter of fact, it is almost impossible to make the aforementioned conventional image recording apparatus smaller.

It is to be noted that because the paper tray 6 and the delivery tray 19, which are separate members, are mounted to the main body 1*a* for an actual use of the image recording device 1, an additional space for installing both members 6 and 19 is also required.

SUMMARY OF THE INVENTION

An essential object of the present invention is therefore to provide an image recording apparatus which does not occupy much space for installation, and which offers improved convenience and maintainability.

The present invention has improved on an image recording apparatus having a feeding system for feeding sheets of paper one by one; a process system for performing an electrophotographic process, which includes means for sensitizing a photosensitive drum, means for forming an electrostatic latent image on the photosensitive drum, means for developing the electrostatic latent image with toner, and means for transferring a developed image to a sheet of paper fed by the feeding system; a fixing system for fixing a transferred image onto the sheet; an optical system for irradiating the photosensitive drum; and a delivery, wherein the feeding system, the process system, and the fixing system are arranged in a main body in this order on a path along which a sheet is conveyed.

A main characteristic feature of the present invention is that the feeding system is positioned in an upper portion of the main body, and the process system and the fixing system both are positioned diagonally below and forward of the feeding system such that a paper path connecting the feeding system and the fixing system descends forward. In this case, the process system partially underlies the feeding system. In, addition, the optical system may be disposed in a lower, portion of the main body in such a manner as to partially underlie the process system.

Due to this structure, if the paper path has the same length, the area occupied by the apparatus of the present invention is smaller than that occupied by the prior art apparatus wherein the feeding system, the process system and the fixing system are aligned in a horizontal direction. This principle is shown in FIGS. 16A and 16B and will be explained in detail later.

Another feature of the invention is that the process system is constituted as a single unit detachable from the main body through a front cover. This single unit can be divided into two parts which are separable from each other: a first part including a developer and a toner cartridge, and a second part including a photosensitive drum, a charger, a transferrer, and a cleaner.

Due to this structural feature, a replacing operation of the unit of the process system can be easily performed. In addition, when the toner cartridge runs short of toner, it is possible to continue using the photosensitive drum.

BRIEF DESCRIPTION OF THE DRAWINGS

These and other objects and features of the present invention will become clear from the following description taken in conjunction with the preferred embodiments thereof with reference to the accompanying drawings throughout in which like parts are designated by like reference numerals, and in which.

DETAILED DESCRIPTION OF THE PREFERRED EMBODIMENTS

Figure 1:
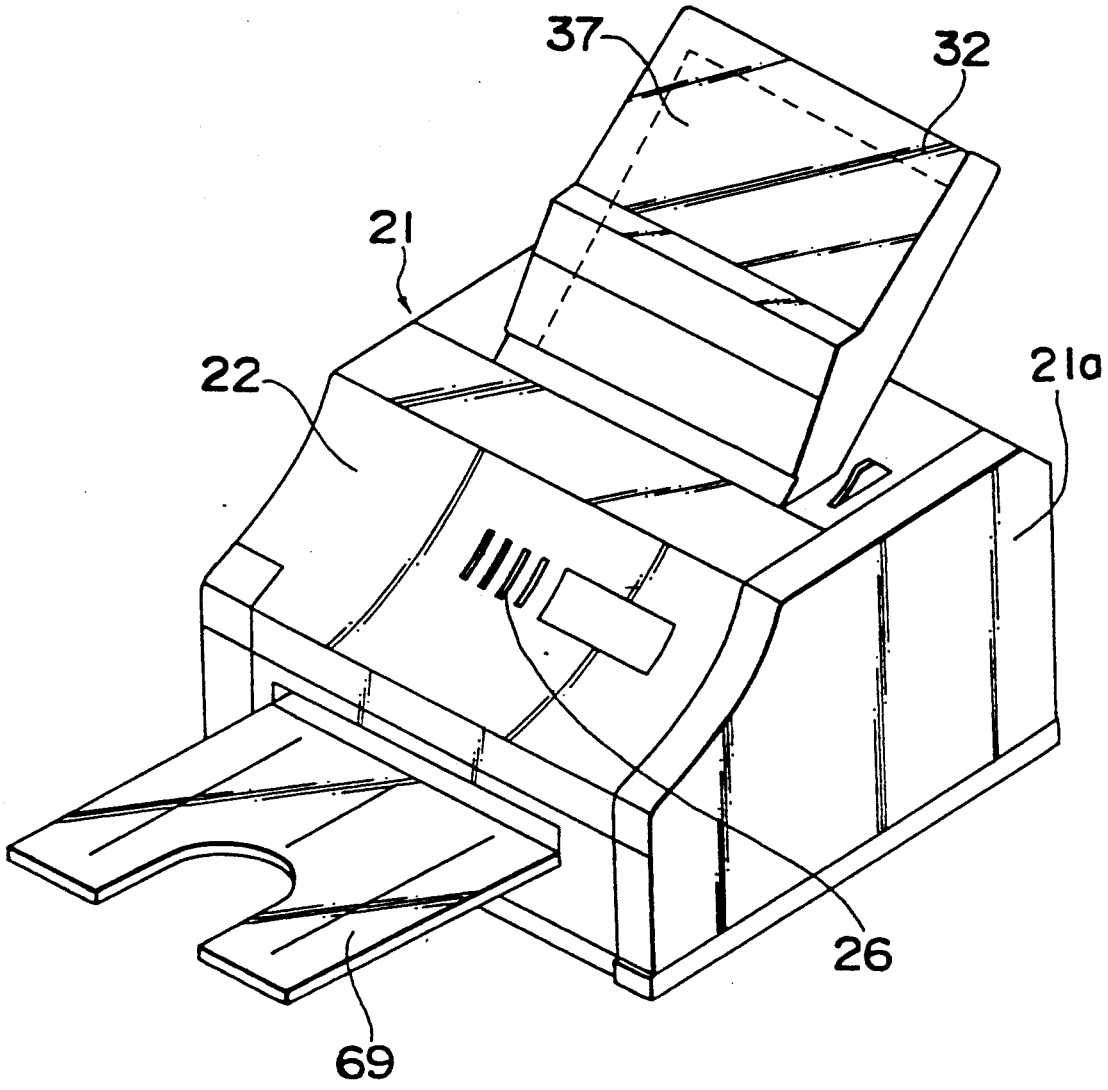
FIG. 1 is a perspective view of an entire image recording apparatus according to a first embodiment of the present invention.

Referring now to FIG. 1, a reference number 21 generally indicates an image recording apparatus according to a first embodiment of the present invention. A main body 21*a* of the image recording apparatus 21 has a front cover 22. The front cover 22 is provided with an operating portion 26. Commands for controlling a paper feeding system, a process system, a fixing system, an optical system, etc. (particularly described later) are input to the apparatus via the operating portion 26. A paper tray 32 is a component of the paper feeding system and a pile of sheets of paper 37 is placed on the paper tray 32.

Figure 2:
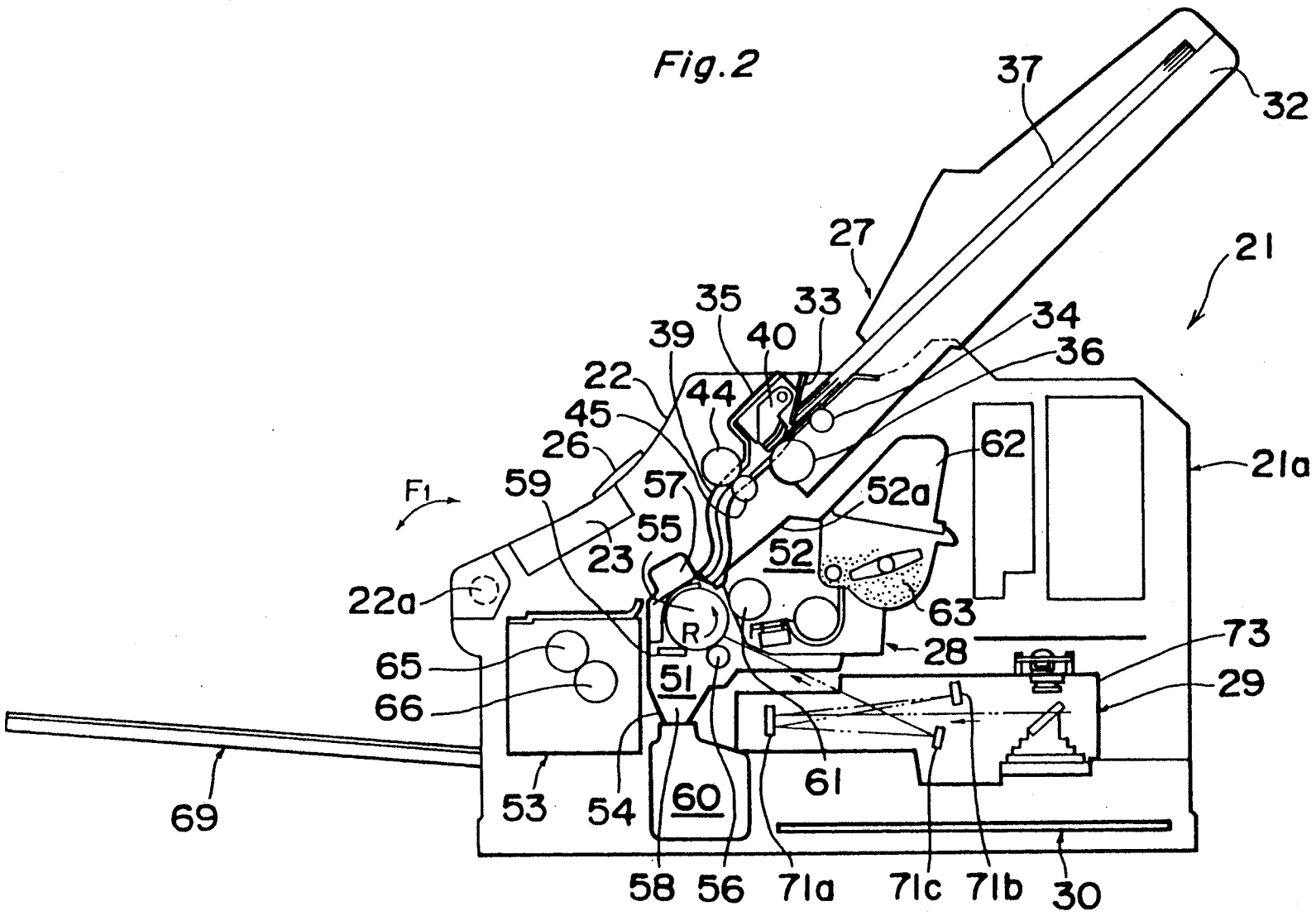
FIG. 2 is a view showing the arrangement of essential parts of the image recording apparatus of the first embodiment, wherein each system is surrounded by a thick line.

FIG. 2 shows an internal structure of the main body 21*a* of the image recording apparatus as seen from a lateral side. In FIG. 2, the paper feeding system indicated by a reference number 27 is disposed in an upper portion of the main body 21*a*. The process system and fixing system designated respectively 28 and 53 are sequentially positioned diagonally below and at the same time forwardly (to the left in the drawing) of the paper feeding system. The optical system indicated by a reference number 29 is provided at the bottom of the main body 21*a* and a delivery system 69 is provided in the front of the main body 21*a*.

The following describes the structure of each system.

Figure 3:
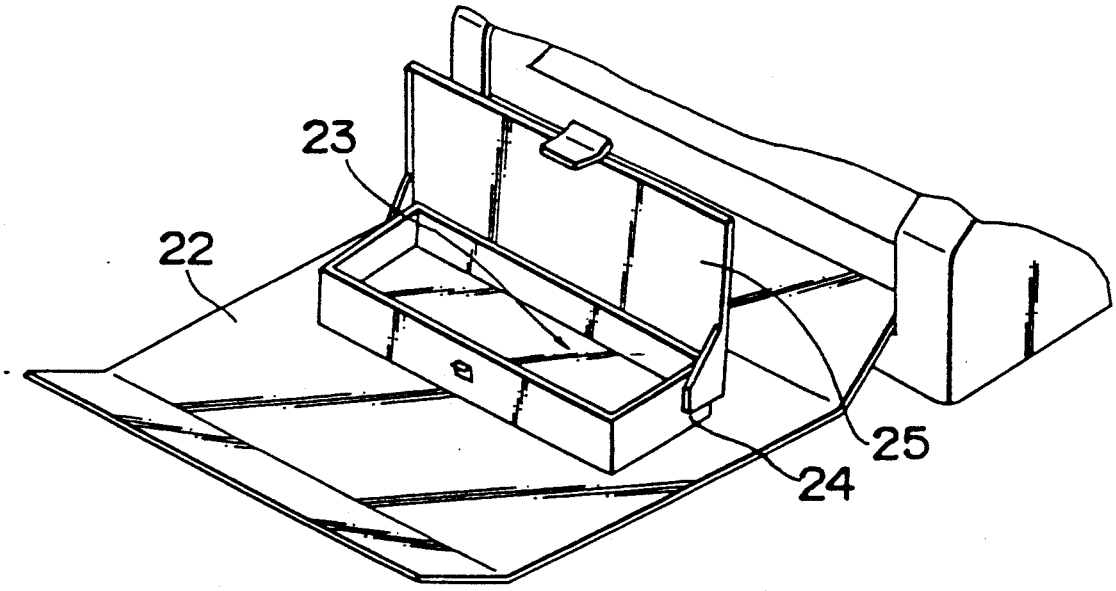
FIG. 3 is a view showing a container provided on the back of a front cover of the image recording apparatus of the first embodiment.

First, the main body 21*a* is described. The front cover 22 of the main body 21*a* is carried by a support 22*a* provided in a lower portion of the main body 21*a* pivotably in a direction of arrow $F_1$ such that the front cover 22 can be freely opened and closed. As shown in FIG. 3, a container 23 is integrally formed on the back of the front cover 22. The container 23 consists of a box 24 and a lid 25 which is pivotable such that the box 24 can be opened and closed. Users can conveniently put items such as, for example, a maintenance kit, a spare toner cartridge, etc. in the container 23. It is possible to constitute the container 23 as a separate member so that the container 23 is removable.

Next, the paper feeding system is described. The paper feeding system 27 is constituted of the paper tray 32, a paper guide 33, a roller 34, a separator 35 and a pick-up roller 36. Sheets 37 of paper are collectively placed on the paper tray 32. Frontal ends of the sheets 37 are regulated by the paper guide 33. The roller 34 leads the sheets 37 toward between the separator 35 and the pick-up roller 36.

Figure 4:
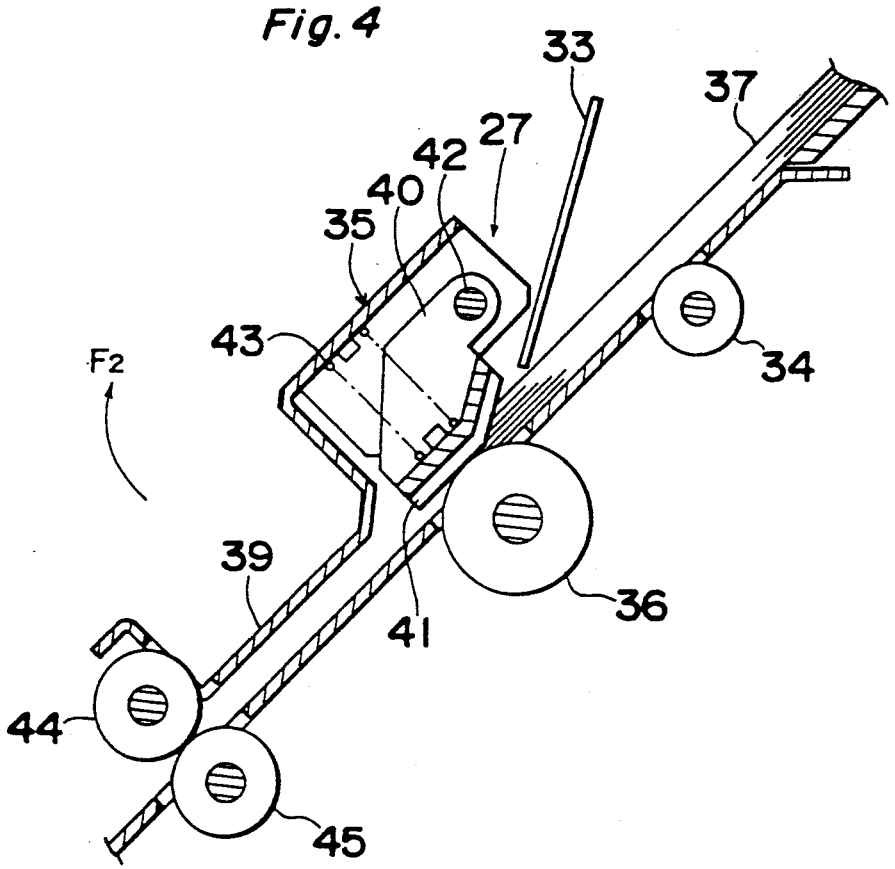
FIG. 4 is a sectional view of essential parts of a paper feeding system in the first embodiment.
Figure 5:
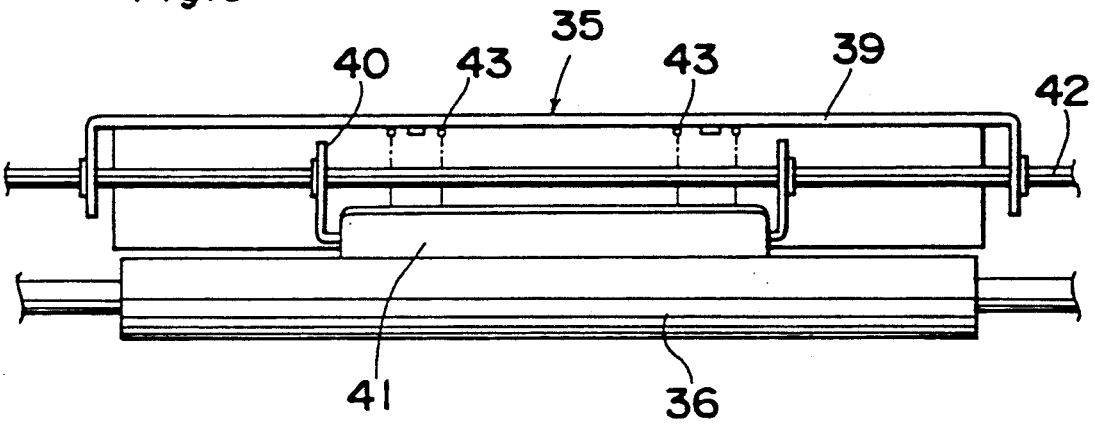
FIG. 5 is a view of the paper feeding system of FIG. 4 seen from a paper tray side.

FIG. 4 is a sectional view of the vicinity of the separator 35 taken in a paper conveyance direction. FIG. 5 is a view of the vicinity of the separator 35 as seen from the rear. As shown in these figures, the separator 35 has a guide 39 and a pick-up plate 40. The guide 39 functions as a paper guide as well. The pick-up plate 40, which has a specified width, is provided opposite the pick-up roller 36. A friction member 41 formed of silicon rubber or other materials is fixedly attached to a surface of the pick-up plate 40 which opposes the pick-up roller 36. The guide 39 and the pick-up plate 40 are pivotable around a common shaft 42. Two springs 43 are disposed in a contracted manner between the guide 39 and the pick-up plate 40 so that the pick-up plate 40 contacting the pick-up roller 36 is pressed onto the pick-up roller 36 by the spring force of the spring 43 while the guide 39 is in a position shown in FIG. 4. Thereby, a frictional force is applied to the paper sheets 37 and a sheet is separated from the other sheets 37 without fail. When the guide 39 is rotated in the direction of arrow $F_2$ (FIG. 4) to open, the pick-up plate 40 is separated from the pick-up roller 36. Due to this structure, it is possible to promptly take action against a paper jam or other troubles occurring during operation. In addition, a cleaning operation for the pick-up roller 36 and the pick-up plate 40 is very easy. The pick-up roller 36 takes up a paper sheet 37 contacting the pick-up roller 36 (at the bottom in this case). The paper sheet 37 taken up by the pick-up roller 36 is conveyed to the process system 28 by rollers 44 and 45.

Figure 6:
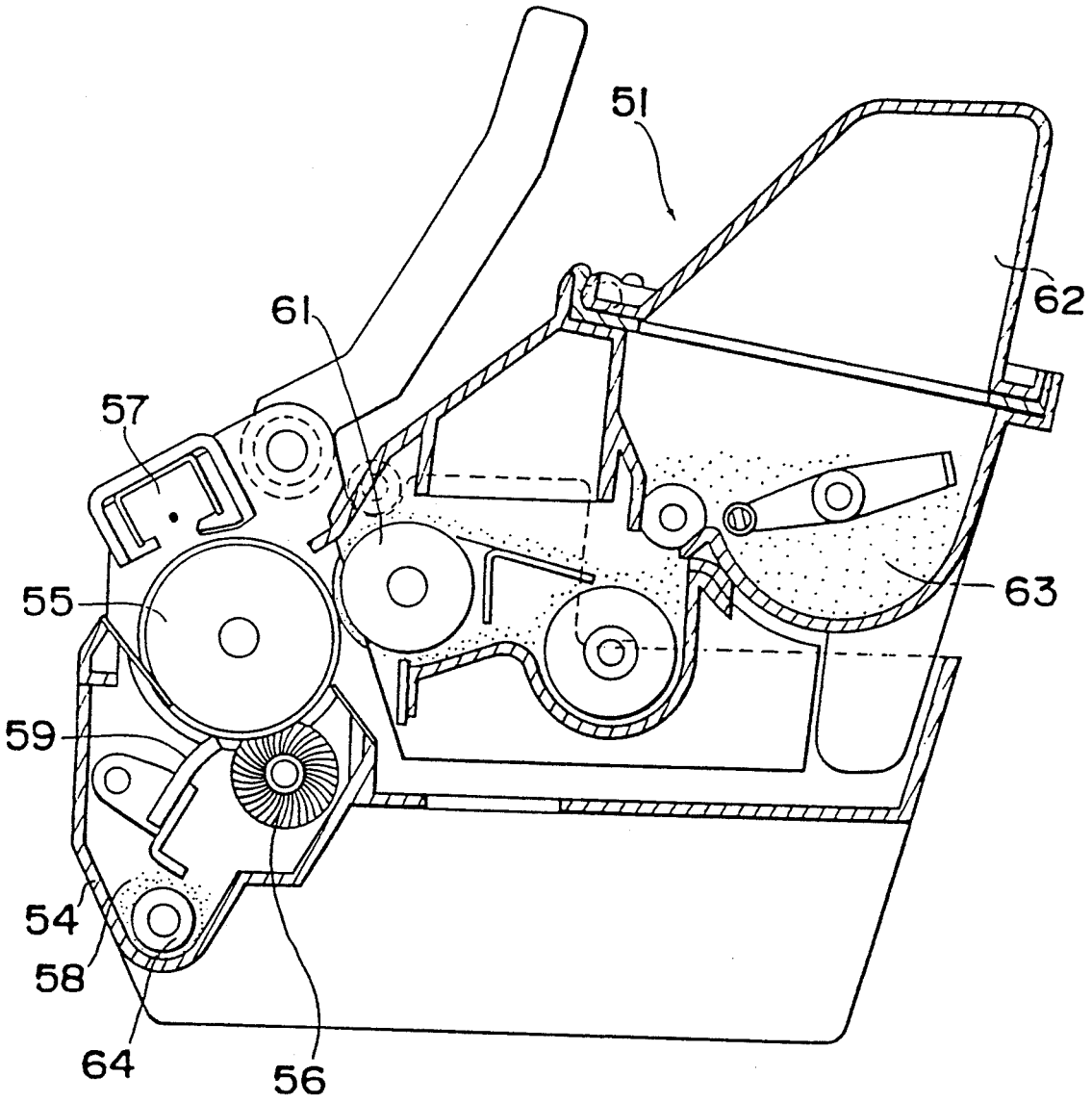
FIG. 6 is a partially sectional view of an entire process unit in the first embodiment.

Now, the process system is described referring to FIGS. 2 and 6 and FIGS. 7A and 7B. The process system 28 has a process unit 51 and a used-toner casing 60. FIG. 6 shows the structure of the process unit 51. As shown in FIG. 6, a photosensitive drum 55, a charger 56, a transferrer 57, a cleaner 58, a magnetic roller 61 and a toner cartridge 62 are provided integrally in a casing 54 formed of, for example, resin. This process unit 51 is removably provided in place in the main body 21*a* of the image recording apparatus 21. When the process unit 51 is installed in the main body 21*a*, the photosensitive drum 55 is linked to a driving device (not shown) while the charger 56 and the transferrer 57 are connected with electrical contacts (not shown). As a result, the electrophotographic process becomes available.

The photosensitive drum 55 is constituted from a conductive body such as aluminum covered with a photoconductive layer. This photosensitive drum 55 is rotatably supported in position by a holder (not shown) in the casing 54. It is to be noted that the photosensitive drum 55 is allowed to be driven to rotate in the direction of arrow R (FIG. 2) by the aforementioned driving device (not shown) when the process unit 51 is installed in the main body 21*a* of the image recording apparatus 21.

The charger 56 is constituted of scorotron unit or a contact sensitizing device. This charger 56 uniformly applies negative charges to a peripheral surface of the photosensitive drum 55. When the photosensitive drum 55 is exposed to light rays emitted from the optical system 29, the negative charges at exposed parts disappear and an electrostatic latent image is formed on the surface of the photosensitive drum 55. In this embodiment, a charging brush which performs contact sensitizing is used as the charger 56. Although the charging brush is rotatably mounted in this embodiment, this brush may be fixed. On the other hand, the transferrer 57 may be constituted of a corotron unit. This transferrer 57 applies positive charges to a sheet 37 coming from the paper feeding system 27. Thereby, toner 63 adhering to the photosensitive drum 55 is attracted to the sheet 37. Image transfer is effected in this way.

The cleaner 58 is for removing the toner remaining on the photosensitive drum 55. This cleaner 58 has a blade 59 constituted of a silicon rubber plate. One end of the blade 59 contacts the photosensitive drum 55 to scrape the residual toner 63 from the photosensitive drum 55 while the drum 55 is rotating. The scraped toner 63 is discharged into the used-toner casing 60 by a rotary screw 64.

The magnetic roller 61 rotatably provided in a casing 52*a* constitutes a developer 52. The magnetic roller 61 is disposed in the place adjacent to the photosensitive drum 55, carrying toner 63 around its outer peripheral surface. The magnetic roller 61, so disposed, applies the toner 63 to the photosensitive drum 55 so that the toner 63 are attracted to the electrostatic latent image area on the photosensitive drum 55. The toner cartridge 62 contains toner 63 to be supplied to the casing 52*a*.

Figure 7A:
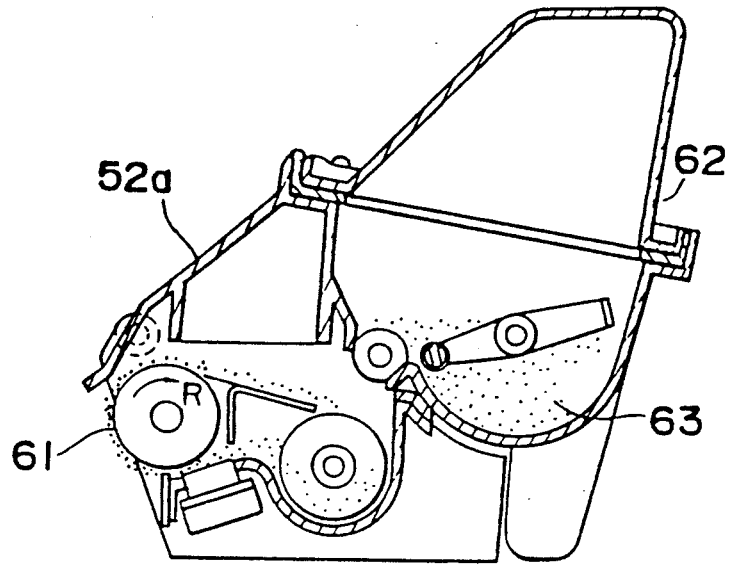
FIGS. 7A and 7B are views respectively showing component units of the process unit which are separated from each other.
Figure 7B:
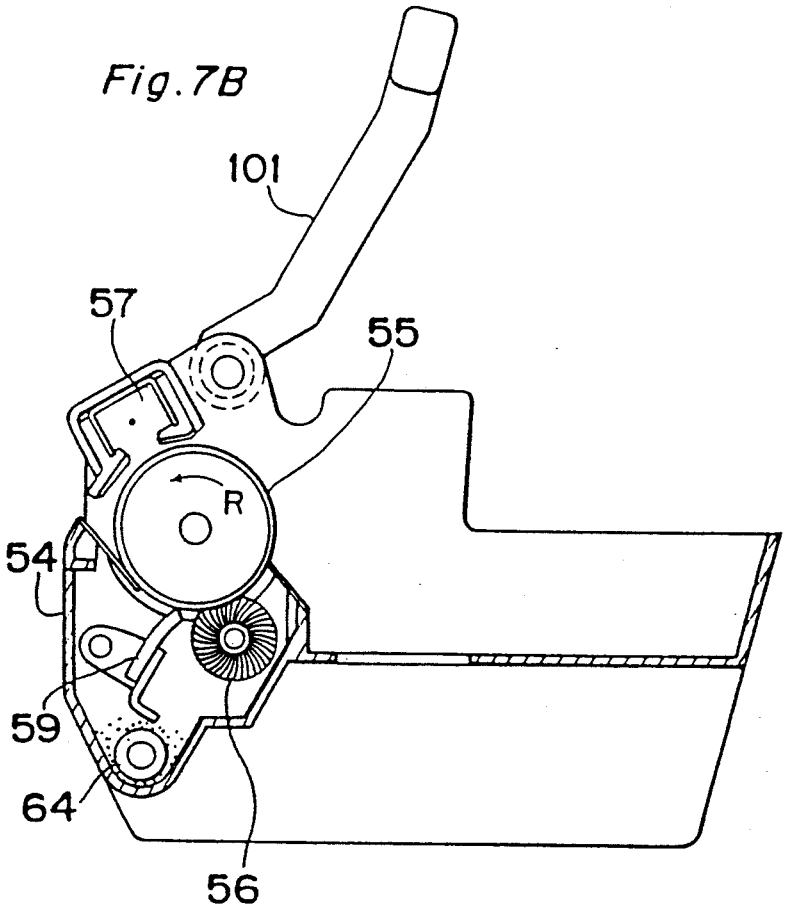

The process unit 51 can be divided into two units (respectively shown in FIG. 7A and FIG. 7B) by the operation of a lever 101: one unit having the toner cartridge 62 and magnetic roller 61 as shown in FIG. 7A, and the other is a unit having the photosensitive drum 55, charger 56, transferrer 57, cleaner 59, etc. as shown in FIG. 7B. Since the two units constituting the process unit 51 are separable from each other, it is not necessary to replace the entire process unit 51 only because the toner cartridge 62 is used up. And it is possible to continue using the photoconductive drum 55 which is still usable. This feature of the process unit 51 provides a very economical image recording apparatus. Also, as is apparent in FIGS. 6 and 7A, the toner cartridge 62 is separable from the remainder of the first unit.

Furthermore, the process unit 51 can be readily removed by only opening the front cover 22. This structure allows for easy maintenance of the image recording apparatus.

In the present embodiment, a destaticizer is omitted because the image recording apparatus of this embodiment is directed to the recording of images at a speed as low as 3 or 4 sheets per minute. More specifically, if the recording speed is that low, the surface charges applied by the charger 56 disappear spontaneously. For this reason, it is not necessary to remove residual surface charges on the photosensitive drum 55 by applying charges opposite in polarity to the residual charges. However, a destaticizer may be installed. In this case, high-speed image recording can be achieved if the destaticizer is in contact with the photosensitive drum 55.

The following describes the fixing system. The fixing system 53 has a pressure roller 65 for applying pressure only to a sheet 37 and a heat roller 66 for applying both pressure and heat to the paper 37 (See FIG. 2). The fixing system 53 heats and presses the sheet 37 conveyed from the process unit 51 so as to fusion bond the toner 63 onto the sheet 37. It is to be noted that the pressure roller 65 is disposed over the heat roller 66 in the fixing system 53. Due to this arrangement, it is possible to avoid a danger in which an operator may happen to touch a hot part when the front cover 22 is opened. Thus, safety is secured when the front cover 22 is opened for replacement of the process unit 51 or for other reasons.

The delivery system consists of a delivery tray 69. The sheet 37 having a fixed image is discharged to this delivery tray 69. This delivery tray 69 has a shape adapted to a direction in which the sheet 37 is conveyed.

Figure 8:
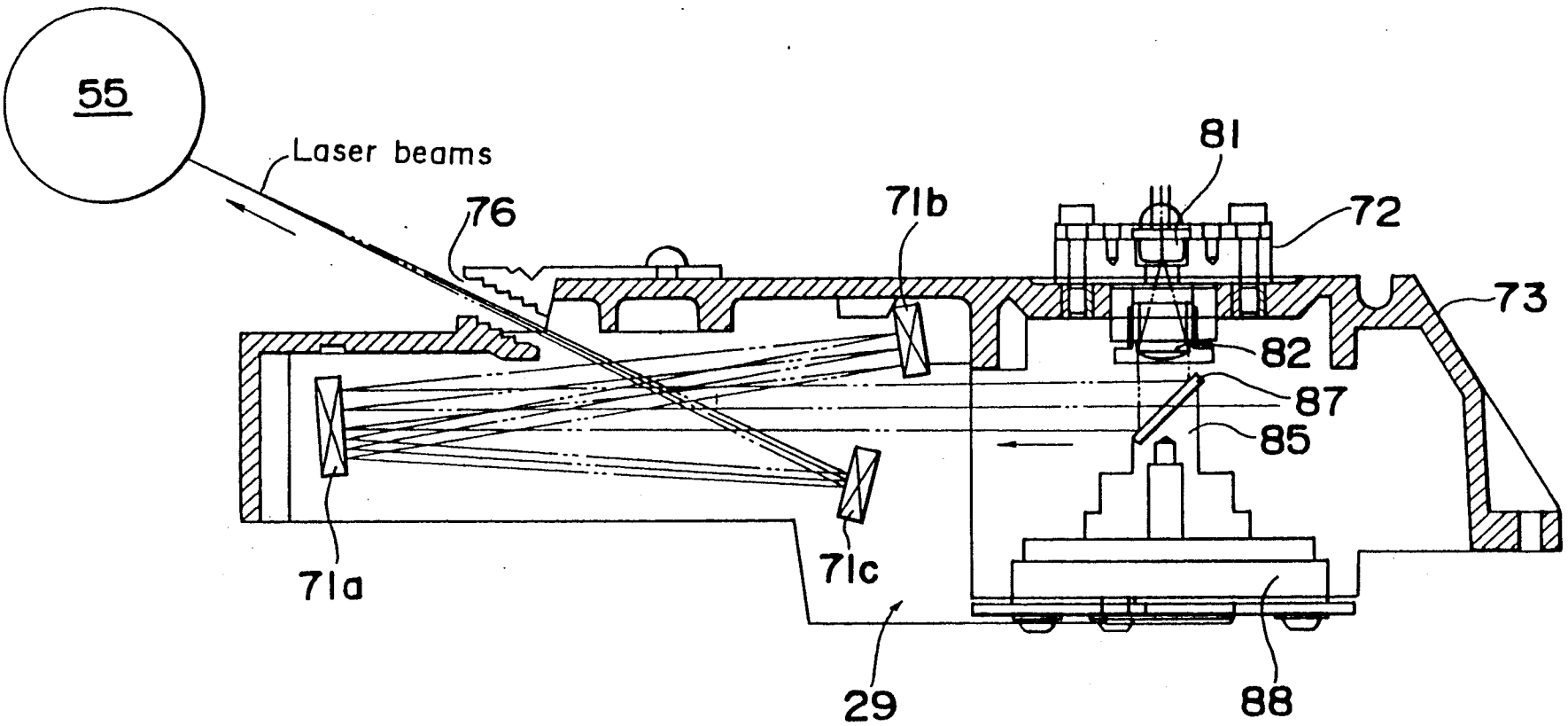
FIG. 8 is a view of an entire optical system in the first embodiment.
Figure 9:
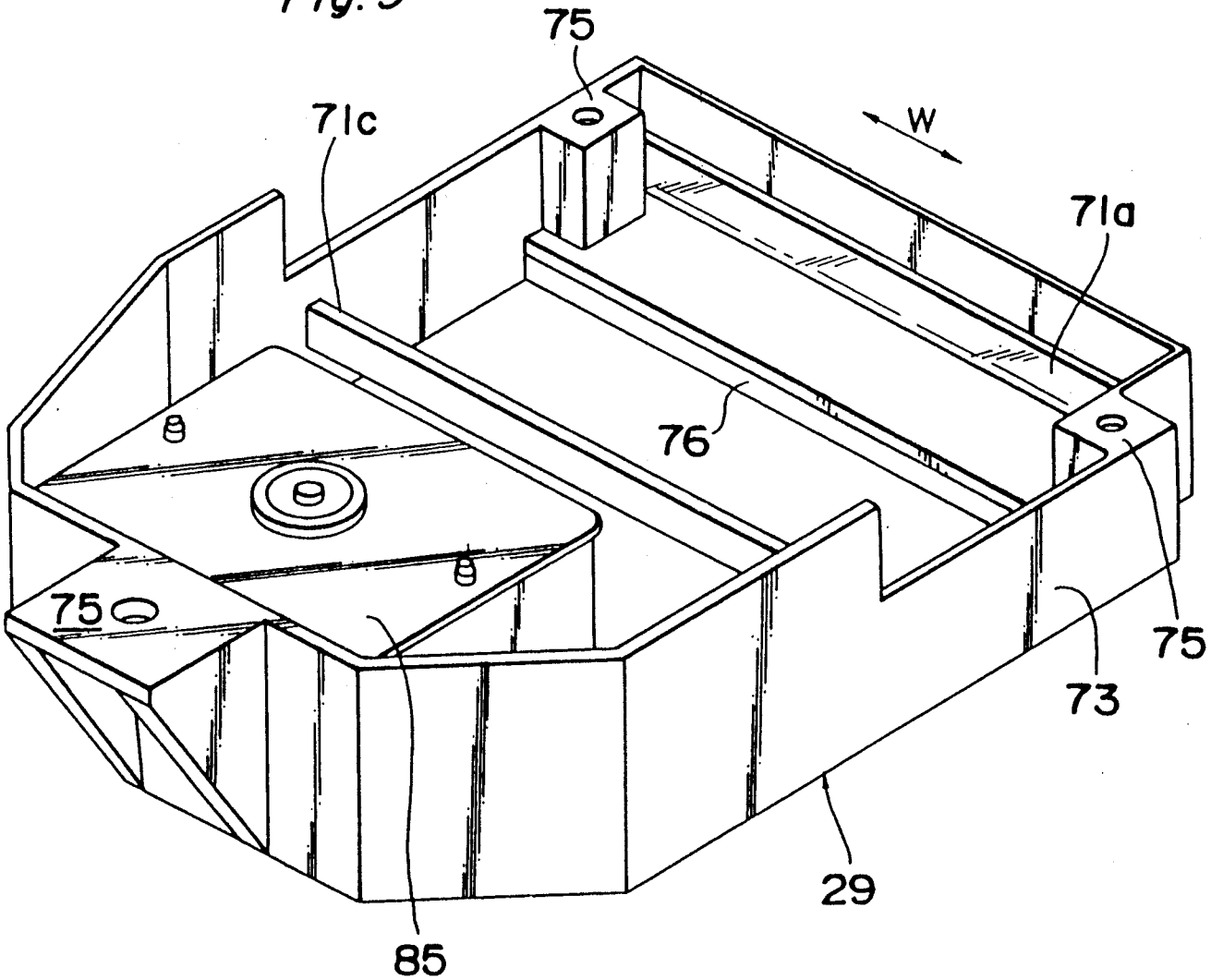
FIG. 9 is a view of essential parts of the optical system of FIG. 8.

Next, the structure of the optical system is described with reference to FIGS. 8 and 9. FIG. 8 is a vertical sectional view of the optical system 29 and FIG. 9 is a view as seen from the backside of the optical system 29.

As shown in FIG. 8, the optical system 29 has a light source unit 72, a mirror unit 85, and three mirrors 71*a*, 71*b* and 71*c*. These components of the optical system 29 are all provided integrally on a chassis 73.

The chassis 73, which is made of, for example, resin, has a rectangular aperture 76 opposite the mirror 71*c*. The aperture 76 is provided on the path of light reflected by the mirror 71*c* so that the light is output from the aperture 76 and irradiates the photosensitive drum 55. The chassis 73 is shaped to cover the components of the optical system 29 for the purpose of protecting the optical system 29 against dust. Dust can enter the optical system 29 from the aperture 76, the only opening of the chassis 73. However, because the aperture 76 has a minimum size for passing the reflected light, very little dust enters the chassis 73. As shown in FIG. 9, the mirrors 71*a*, 71*b* (not shown in FIG. 9) and 71*c* extend in a width direction (indicated by arrow W) of the chassis 73. The mirrors 71*a*, 71*b* and 71*c* in combination reflect light rays coming from the mirror unit 85 toward the aperture 76, specifically toward the photosensitive drum 55.

The chassis 73 is also provided with fitting portions 75 for fixing the entire optical system 29 to the main body 21*a* of the image recording apparatus 21.

The light source unit 72 has a light source 81 and a collimating lens 82 provided below the light source 81. The light source 81 is constituted of a semiconductor laser, for example, and light rays, that is, laser beams emitted from the light source 81 enter the mirror unit 85 via the collimating lens 82.

The mirror unit 85 is constituted from a reflector 87 and a drive motor 88 for rotating the reflector 87. The reflector 87 is inclined at 45 degrees relative to a rotating axis of the reflector 87. A base of the mirror unit 85 is formed of a resin such as plastics. Therefore the base is light and easy to work with. Light rays emitted from the light source unit 72 enter the reflector 87 in parallel with the rotating axis of the reflector 87 and then are perpendicularly reflected by the reflector 87 to enter the mirror 71*a*. This reflector 87 is rotated about the rotating axis at a specified speed by the drive motor 88. The light rays output from the light source 81 are moved in a horizontal direction by the rotation of the reflector 87 to eventually scan the photosensitive drum 55.

The light rays from the mirror unit 85 are then reflected by an upper portion of the mirror 71*a* and then by the mirror 71*b*, and then by a lower portion of the mirror 71*a* and finally by the mirror 71*c*. Then, the light rays reflected by the mirror 71*c* travel out of the aperture 76 and irradiate the photosensitive drum 55.

As is obvious from the above, because light coming from the mirror unit 85 is reflected a plurality of times by a plurality of mirrors, an actual light path is prolonged. As a result, it is possible to reduce the optical aberration in even small devices like the apparatus of the present invention. In this embodiment, the mirror 71*a* is used twice for reflection. Therefore, the structure of the optical system 29 is made simpler.

The systems described above are controlled by a controller 30 provided at the bottom of the main body 21*a* of the image recording device 21 (See FIG. 2). The controller 30 is constituted of a microcomputer, for example. In response to commands transferred from the operating portion 26 or commands transferred from an external device (not shown) connected through a cable (not shown), this controller 30 controls the paper feeding system 27, process system 28 and optical system 29 to reproduce input image information on the paper 37.

In the image recording apparatus with the above structure, the irradiation of the photosensitive drums 55 with laser beams by the optical system 29, the conveyance of the paper 37, and the electrophotographic process by the process system 28 are continuously performed in that order based on input commands and input image data, whereby an input image is recorded on the sheet 37.

The image recording apparatus of the present embodiment has a structure such that the paper feeding system 27 is disposed in an upper position of the main body 21*a* and the process system 28 is positioned diagonally below and in front of the paper feeding system 27 such that the paper feeding system 27 overlaps the process system 28. Therefore, the sheet fed from the top of the main body proceeds diagonally downward toward the front of the main body, unlike the prior art wherein paper is conveyed from a system to another in a horizontal direction. Due to this overlapping arrangement of the systems allowing a slanting paper path, even though an area occupied by each system of the present invention (i.e., the length of the paper path) was equal to that occupied by each system of the prior art apparatus, the installation area of the entire apparatus of the present invention can be reduced. This principle is illustrated in FIGS. 16A and 16B.

Figure 16A:
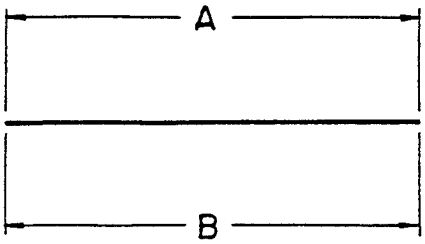
FIGS. 16A and 16B are views each showing a relationship between a paper conveyance distance and an occupied area (installation space) of an apparatus.
Figure 16B:
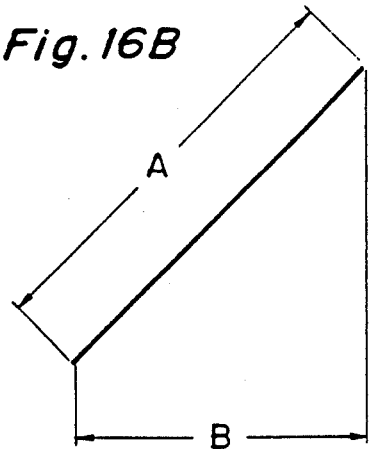

When a sheet is conveyed for a constant length, a horizontal distance B is shorter in the present invention having a slanting paper path (FIG. 16B) than that in the prior art having a horizontal paper path (FIG. 16A). If the width is constant in both cases, it follows that the installation area for the image recording apparatus is smaller in the present invention than in the prior art.

In addition, the paper tray 32 and the delivery tray 69 are positioned in conformity with the slanting paper path. This arrangement of the paper tray 32 and delivery tray 69 also contributes to the reduction of the occupied space. Accordingly, it is possible to considerably reduce the installation space of the overall image recording apparatus.

A second embodiment of the present invention is shown in FIGS. 10 through 15. An image recording apparatus of this second embodiment is generally indicated by a reference number 121 and a main body thereof is indicated by a reference number 121*a*. It is to be noted that components of this embodiment similar in function to those of the first embodiment are indicated by the same reference numbers and a detailed description of some of those components will be omitted.

Figure 11:
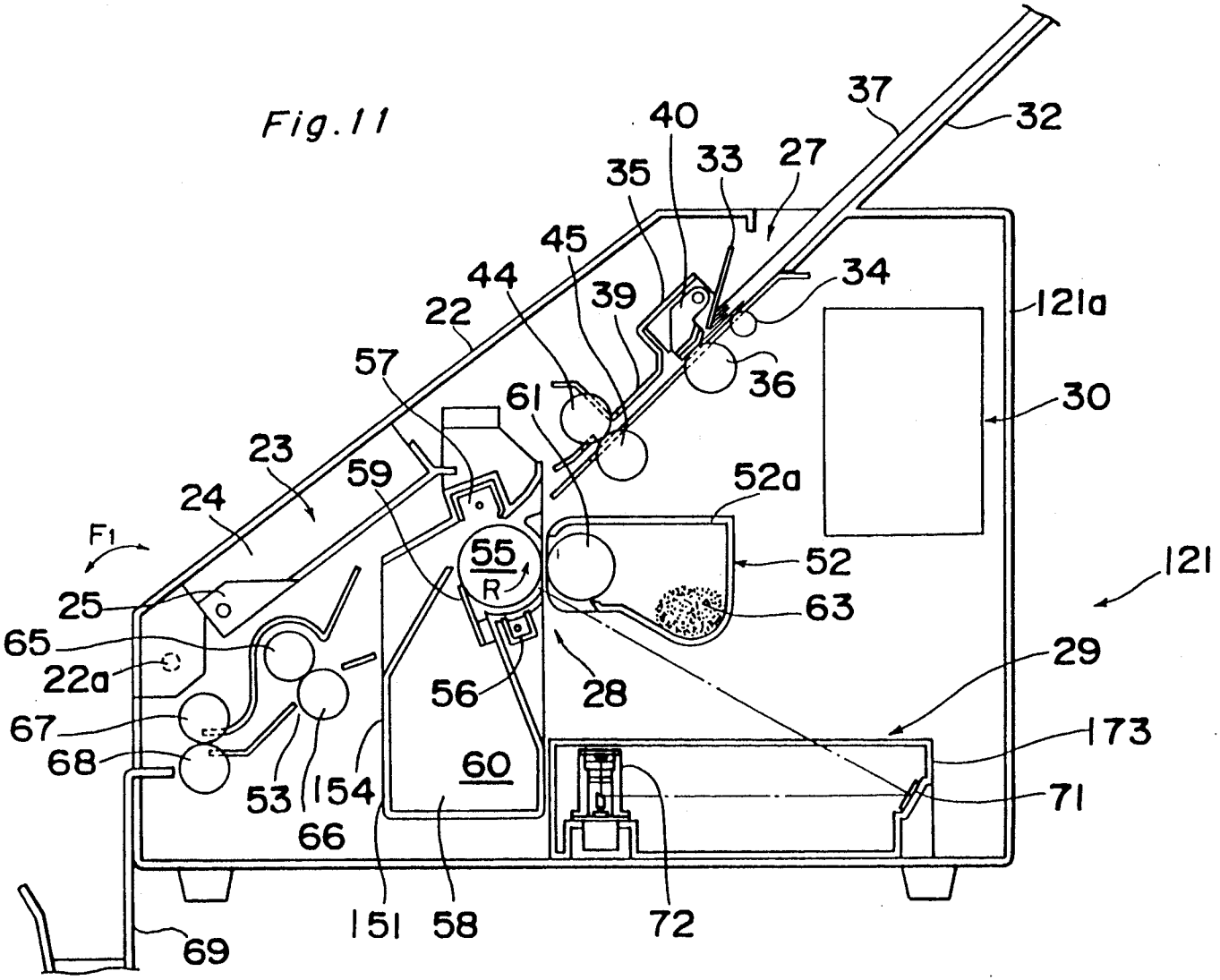
FIG. 11 is a sectional view showing arrangement of essential parts of the image recording apparatus of FIG. 10.
Figure 12:
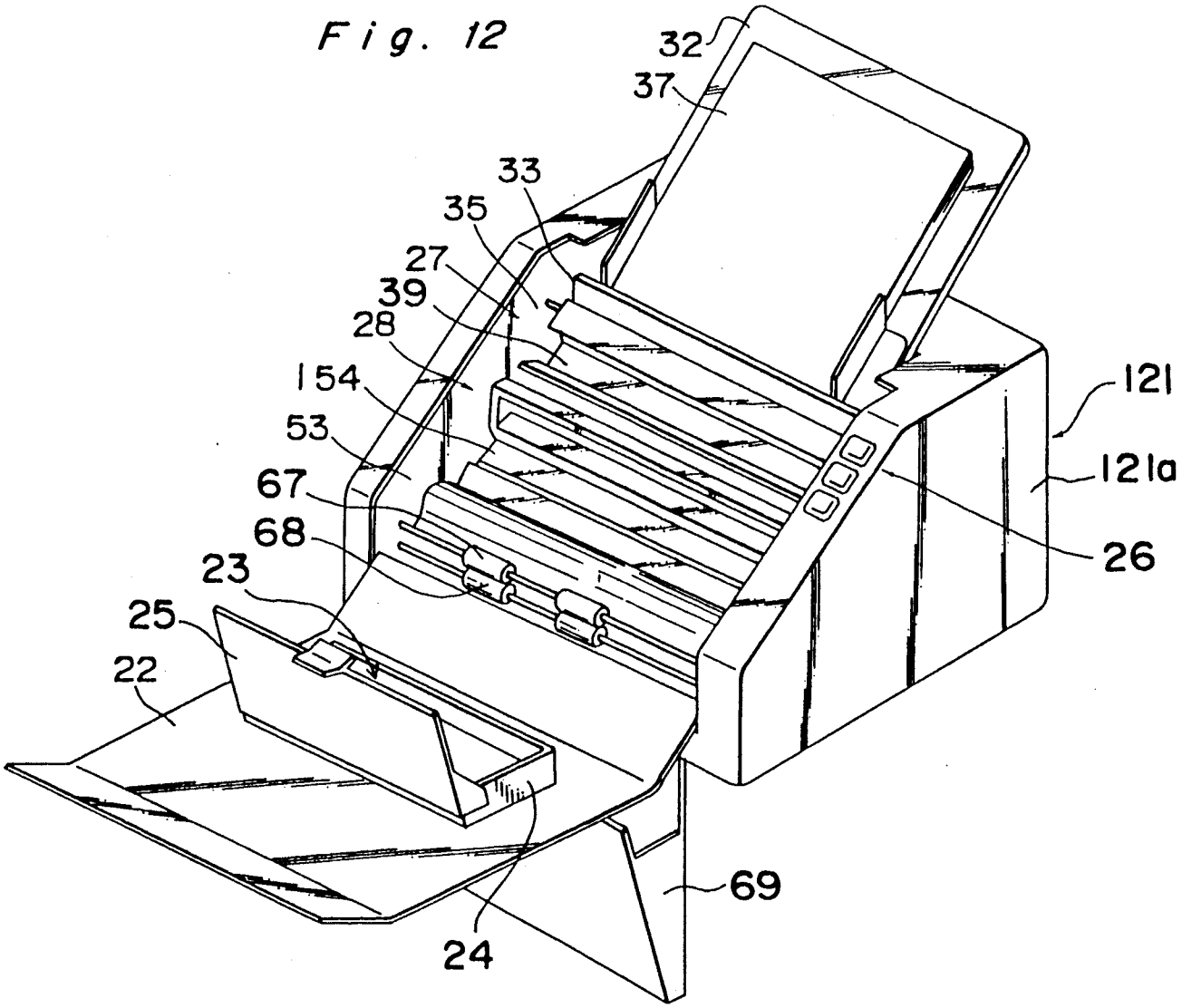
FIG. 12 is a view of the image recording apparatus of FIG. 10 in a state in which a front cover is open.

As shown in FIG. 11, a process system 28 is provided diagonally below and in front of the paper feeding system 27 such that a paper path slopes downward toward the front of the main body 121*a*. The process system 28 has a process unit 151, a developer 52 and a fixing system 53. In this embodiment, the developer 52 is not integrated into the process unit 151. The fixing system 53 and the developer 52 are disposed before and behind the process unit 151, respectively. A toner cartridge (not shown) is connected to a casing 52*a* of the developer 52 for supplying toner 63 to the developer 52.

Figure 13:
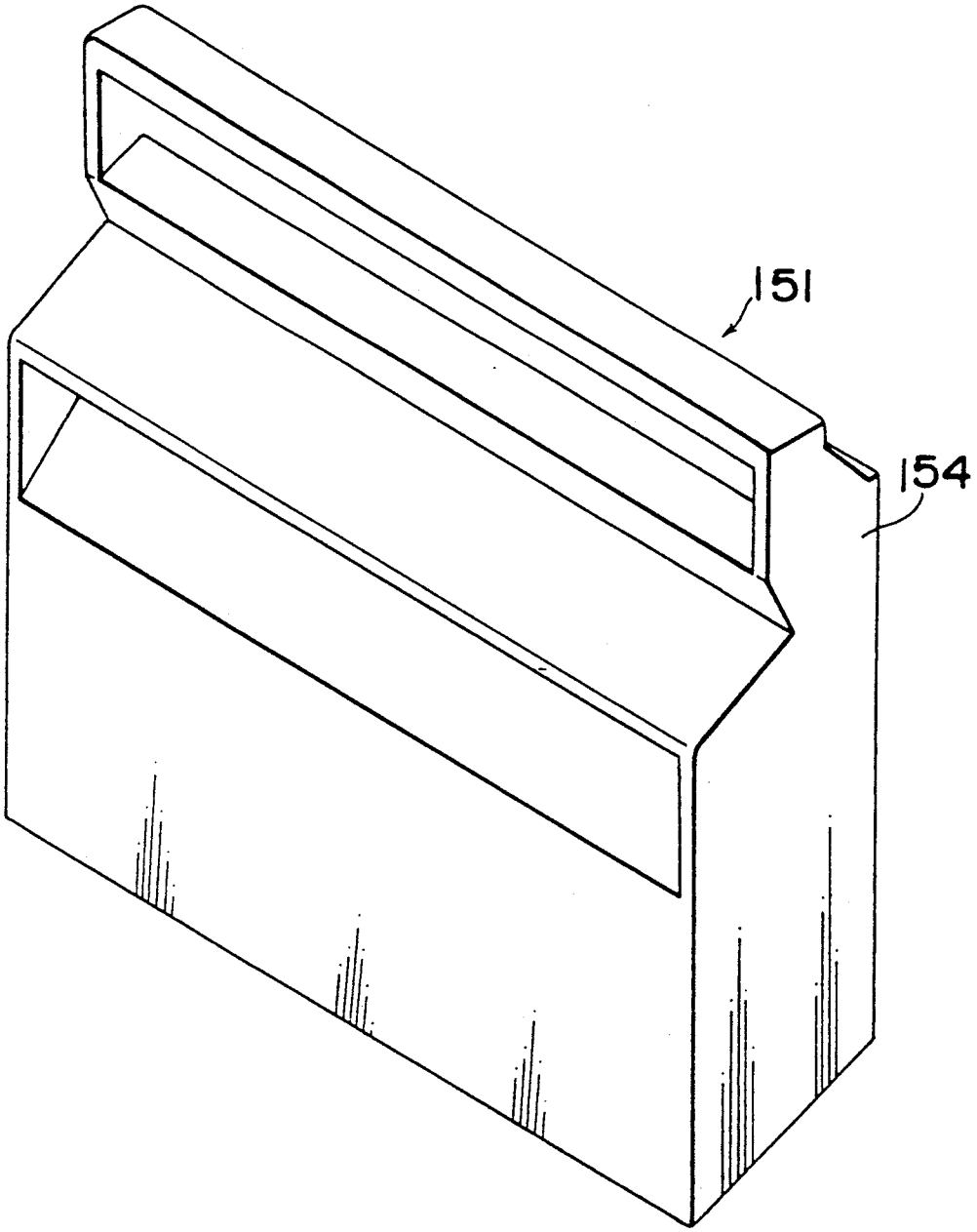
FIG. 13 is a view showing an external appearance of a process unit in the second embodiment.

The process unit 151 has an external appearance shown in FIG. 13. This process unit 151 integrates a photosensitive drum 55, a charger 56, a transferrer 57 and a cleaner 58 in a casing 154. A used-toner casing 60 provided in the casing 154 has a capacity determined on the basis of the lifetime of the photosensitive drum 55. Therefore, the process unit 151 can be used effectively and optimally. The process unit 151 is separable from the developer 52. Therefore, the process unit 151 can be replaced with a new process unit 151 at the different time than when replacing the toner cartridge (not shown).

In this embodiment, the charger 56 is constituted from a scorotron unit and the transferrer 57 is also constituted from a scorotron unit.

Figure 10:
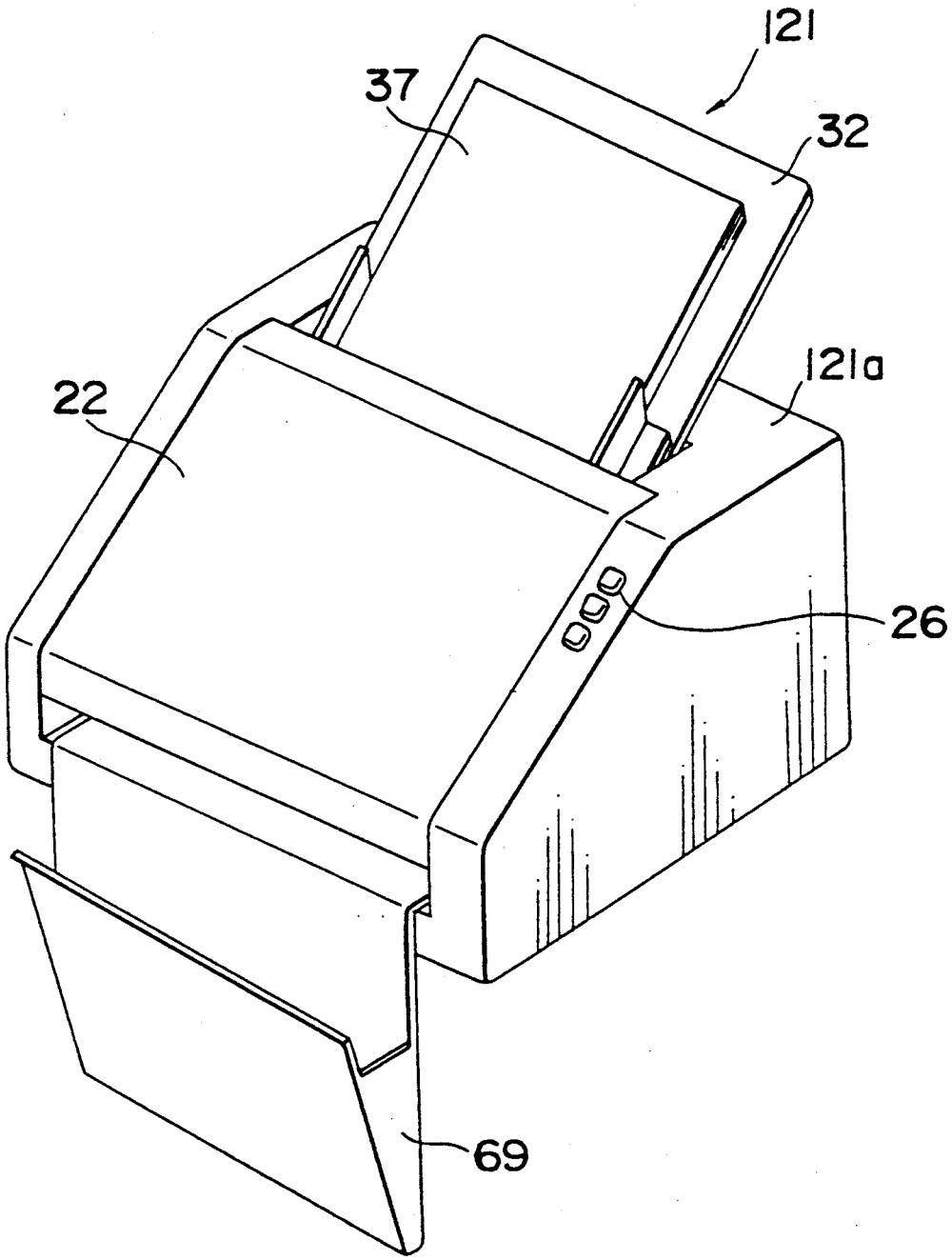
FIG. 10 is a perspective view of an entire image recording apparatus according to a second embodiment of the present invention.

A delivery tray 69 has a bag-like shape and extends downward of the main body 121*a* as shown in FIGS. 10 and 11. Because of this shape, the delivery tray 69 does not occupy much additional space in a longitudinal direction, when compared with a delivery tray extending in the longitudinal direction.

A sheet 37 conveyed from the fixing system 53 is discharged by rollers 67 and 68 into the bag-like delivery tray 69.

Figure 14:
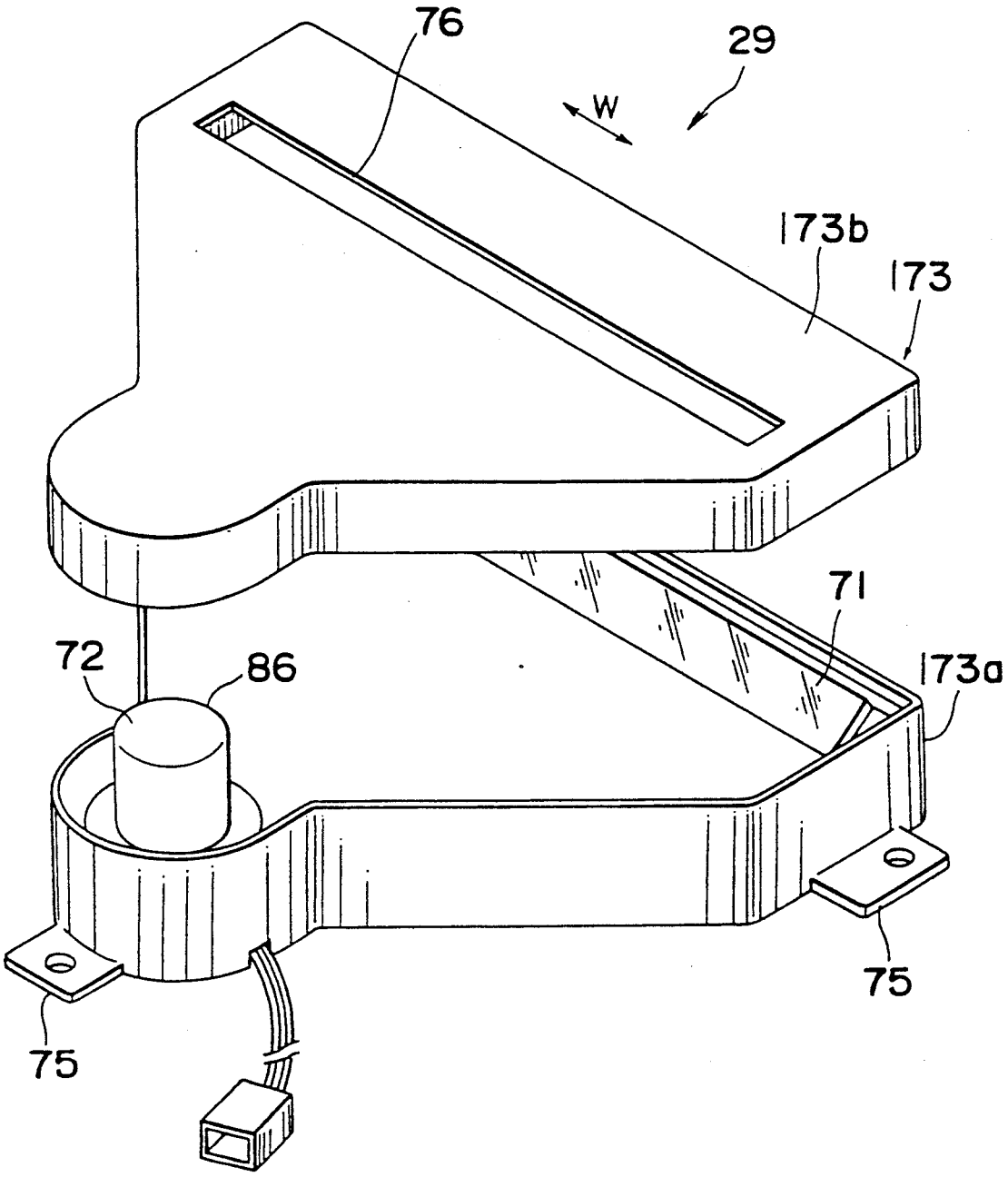
FIG. 14 is a view showing an optical system in the second embodiment.
Figure 15:
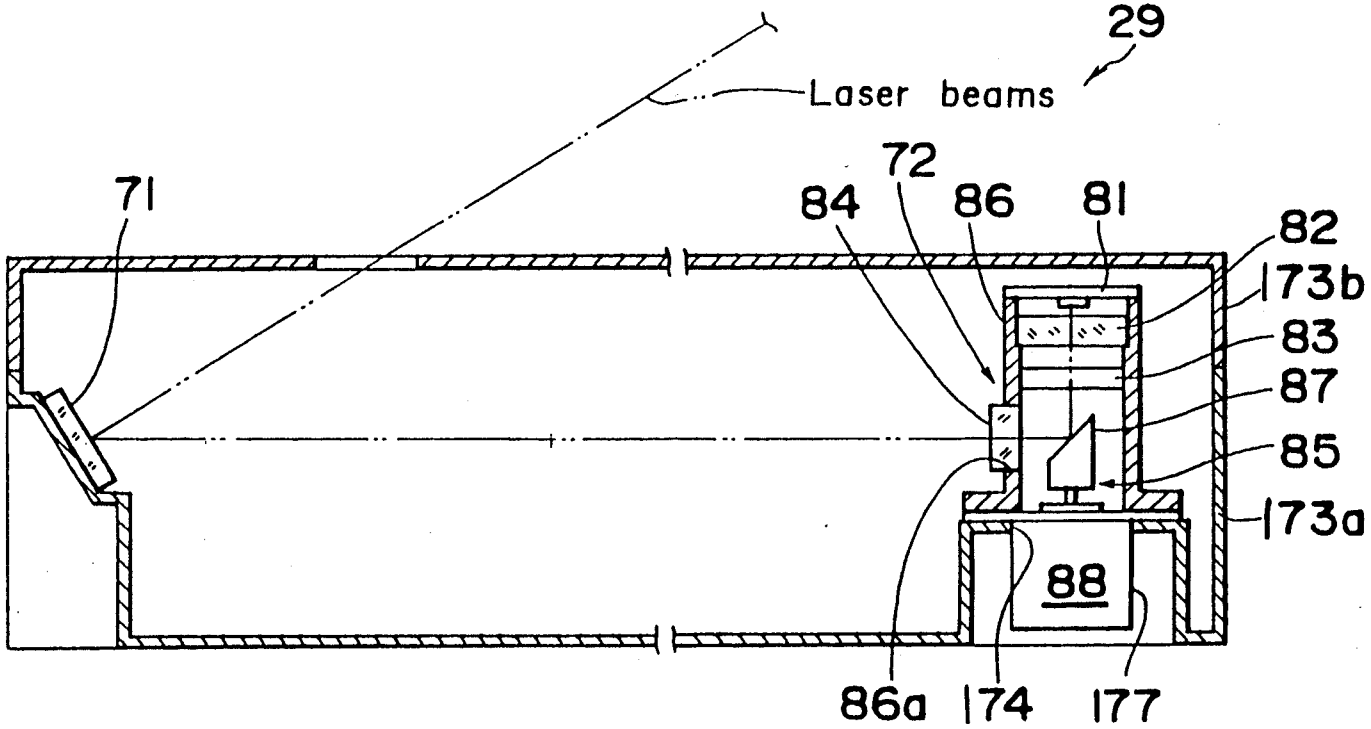
FIG. 15 is a sectional view of the optical system of FIG. 14.

As shown in FIGS. 11 and 14–15, an optical system 29 provided at the bottom of the main body 121*a* is accommodated in a housing 173. The housing 173 consists of upper and lower housing parts 173*b* and 173*a* each of a sector-like shape As shown in FIG. 15, the optical system 29 includes a light source unit 72, a mirror unit 85, a focus lens 84 and a mirror 71. The light source unit 72 and the mirror unit 85 are provided integrally in a casing 86 fixed to a frontal portion of the lower housing part 173*a*. The focus lens 84 is fixed to the casing 86 in a manner closing a window 86*a* provided in a side wall of the casing 86, thus closing the casing 86. Dust is therefore prohibited from entering the casing 86 and the light source unit 72 and the mirror unit 85 (described below in detail) in the casing 86 are prevented from deteriorating.

The light source unit 72 is constituted of a light source 81, a collimating lens 82, and a modulator 83. A semiconductor laser is used as the light source 81.

The mirror unit 85 is constituted from a reflector 87 housed in the casing 86 and the drive motor 88 for rotating the reflector 87. The reflector 87 is inclined at 45 degrees relative to a rotating axis of the reflector 87. The drive motor 88 is fitted in an opening 174 provided in the lower housing part 173*a* and accommodated in a recess 177 formed at the bottom of the lower housing part 173*a*.

The mirror 71 is fixed to the lower housing part 173*a* in a position determined in consideration of a direction in which light rays will be reflected by the mirror 71. The mirror 71 extends in a width direction W of the lower housing part 173*a* as shown in FIG. 14. Light rays, specifically laser beams, reflected by the mirror 71 travel out of the housing 173 through an aperture 76 provided in the upper housing part 173*b* toward the photosensitive drum 55 (see FIG. 11).

The upper and lower housing parts 173*b* and 173*a* are assembled into the housing 173 with a single action. The housing 173 accommodating the optical system 129 is fixed to the bottom of the main body 121*a* at fitting portions 75 provided on the lower housing part 173*a*.

The optical system 29 operates as follows. Light rays or laser beams coming from the light source unit 72 in parallel with the rotating axis of the reflector 87 are perpendicularly reflected by the reflector 87. The reflector 87 is rotated about the rotating axis at a specified speed by the drive motor 88. The laser beams reflected by the reflector 87 enter the focus lens 84, continuously moving over the focus lens 84 in a horizontal direction by the rotation of the reflector 87. The laser beams having passed through the focus lens 84 are reflected by the mirror 71 and then irradiate the photosensitive drum 55, as described above.

In this embodiment, a controller 30 constituted of, for example, a microcomputer for controlling the aforementioned component systems such as the paper feeding system, the process system, etc. is provided in an upper, rear position of the main body 121*a*, as shown in FIG. 11. The controller 30 operates in response to commands transferred from an operating portion 26 which, in this embodiment, is provided not on a front cover 22 but in a lateral position of the front of the main body 121*a*. The controller can also operate in response to commands transferred from an external device (not shown) connected through a cable (not shown).

Figure 17:
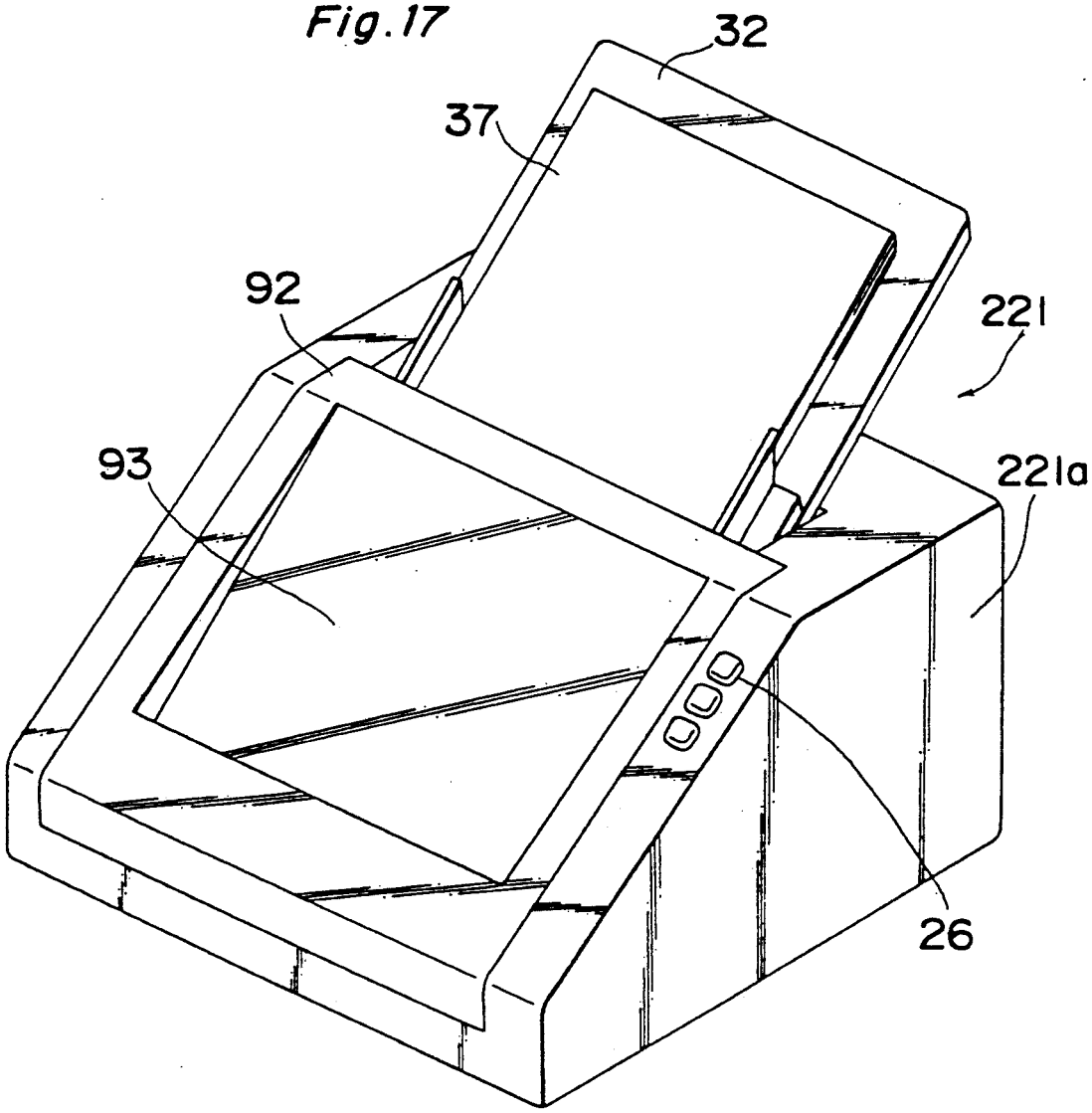
FIG. 17 is a perspective view of an entire image recording apparatus according to a third embodiment of the present invention.
Figure 18:
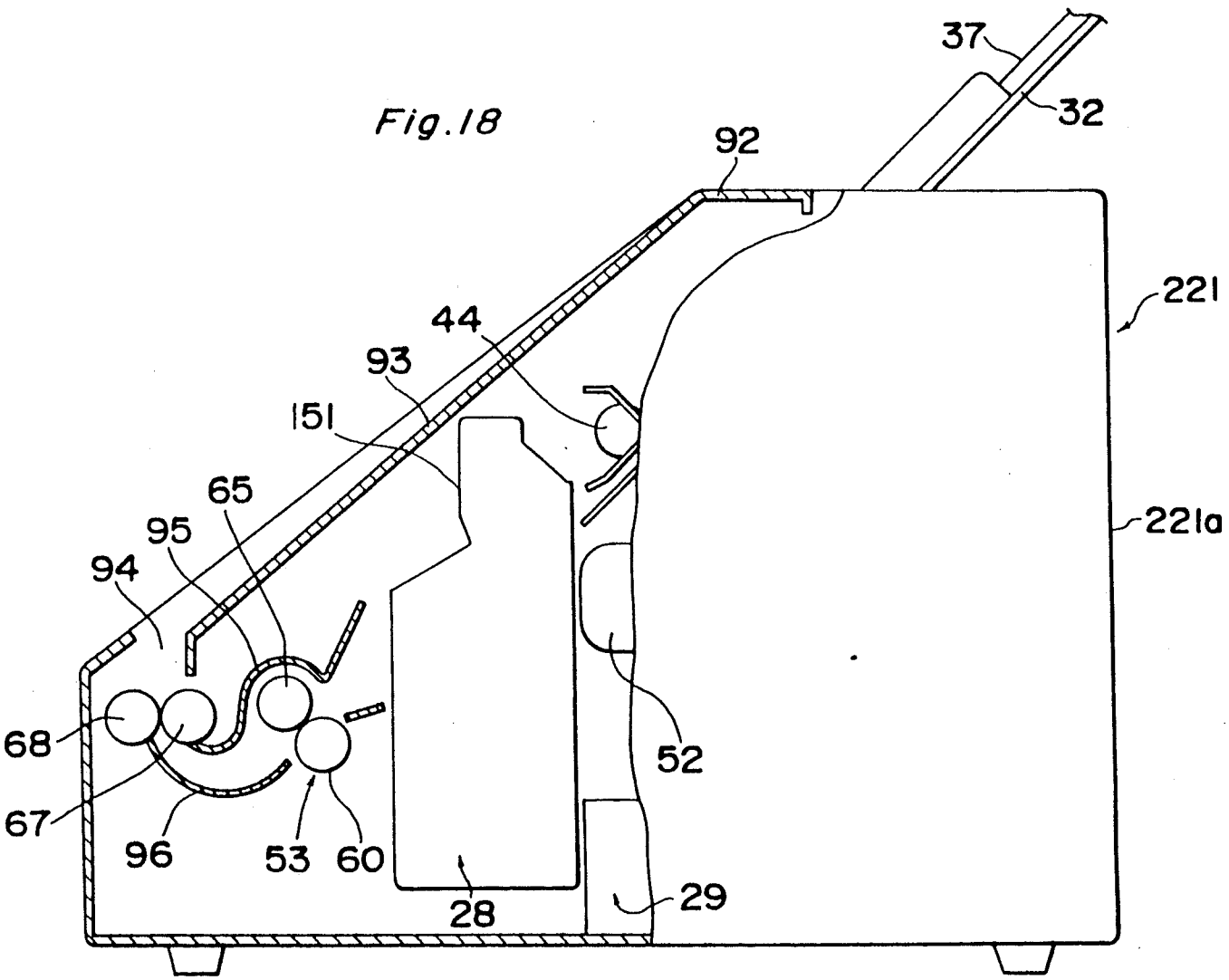
FIG. 18 is a view showing essential parts of the apparatus of FIG. 17.
Figure 19:
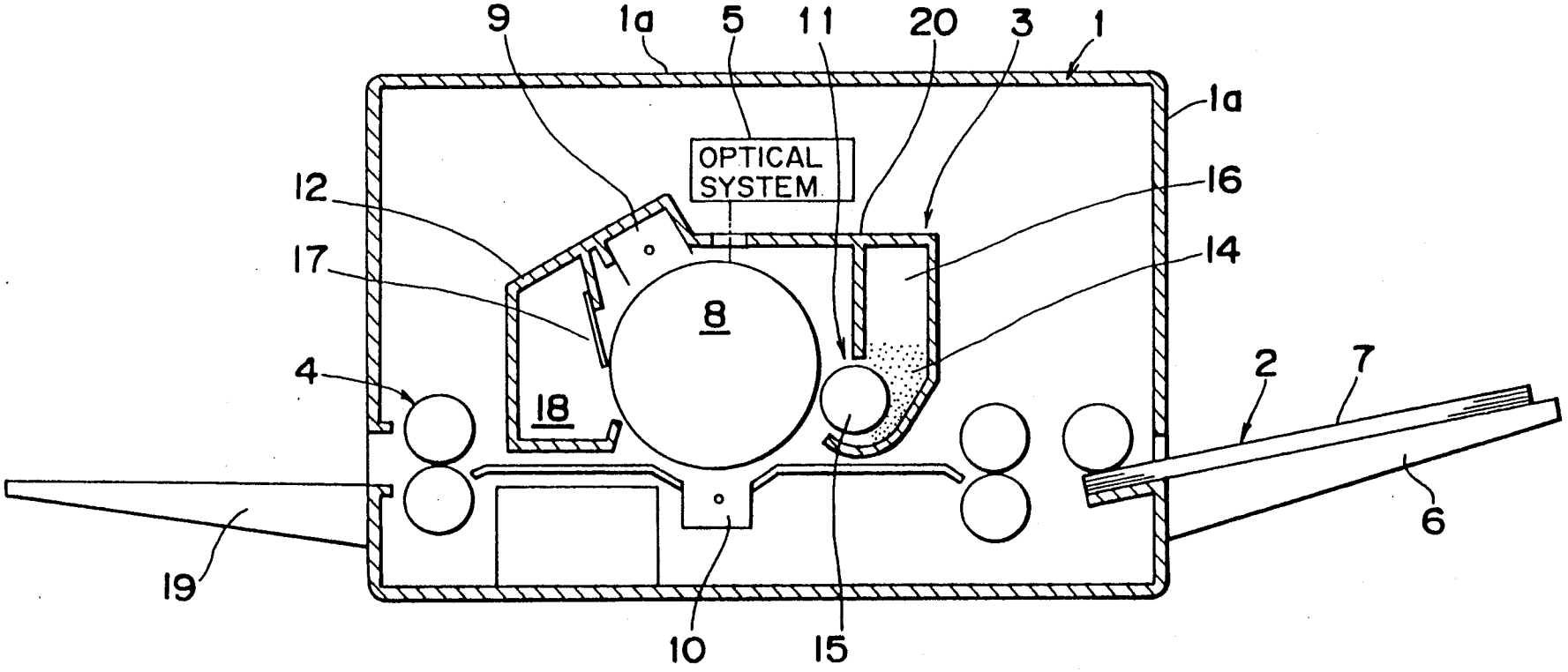
Fig. 19 PRIOR ART
FIG. 19 is a sectional view of essential parts of the prior art image recording apparatus.

A third embodiment of the present invention is shown in FIGS. 17 and 18. In this embodiment, the delivery tray, is integrated with the front cover. Components which are the same as those of the second embodiment are indicated by the same reference numbers and a description of those components is omitted below.

In FIG. 17, an image recording apparatus of the third embodiment is generally indicated by a reference number 221 and a main body thereof is indicated by a reference number 221*a*. A characteristic feature of this embodiment is that a delivery tray 93 is provided integrally on a front cover 92. The delivery tray 93 has a width a little wider than the paper width. As shown in FIG. 18, the delivery tray 93 continues from an opening 94 provided in a lower position of the front cover 92, and reaches the top of the main body 221*a*.

As shown in FIG. 18, guides 95 and 96 are provided on the delivery side of the fixing system 53 for leading a sheet 37 to the opening 94. The sheet 37 carries an image on a bottom surface when processed in the fixing portion 53. However, when the sheet 37 is discharged from the opening 94 to the delivery tray 93, the image is on a top surface of the paper.

This embodiment has the following further advantages.

First, because the delivery tray is integrated with the front cover, an additional space which would be needed for installation of a separate delivery is not required. Thus, space can be saved.

In addition, because a separate delivery tray which is comparatively expensive is not used, a production cost of the apparatus can be decreased.

Furthermore, because the paper is discharged to the front of the apparatus with an image on its upper side, an operator can immediately confirm the recorded contents.

In the above three embodiments, the photosensitive drum 55 is charged with the negative polarity while the paper is charged with the positive polarity. However, it is possible to reverse the polarities of both. In this case, the same effects can also be obtained.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image recording apparatus having feeding means for feeding sheets of paper one by one; process means for performing an electrophotographic process, which include means for sensitizing a photosensitive drum, means for forming an electrostatic latent image on the photosensitive drum, means for developing the electrostatic latent image with toner, and means for transferring a developed image to a sheet of paper fed by the feeding means; fixing means for fixing a transferred image onto the sheet; optical means for irradiating the photosensitive drum; and a delivery tray, wherein the feeding means, the process means, and the fixing means are arranged in a main body in this order on a path along which a sheet is conveyed, the image recording apparatus characterized in that:

the feeding means are positioned in an upper portion of the main body, and the process means and the fixing means both are positioned diagonally below and forward of the feeding means such that a paper path connecting the feeding means and the fixing means descends forward;

the process means include a photosensitive drum constituted from a conductive body covered with a photoconductive layer, a charger for applying charges to a surface of the photosensitive drum so that an electrostatic latent image is formed on the photosensitive drum when the photosensitive drum is irradiated with light rays emitted from said optical means, a single developer only for developing the electrostatic latent image on the photosensitive drum with toner, a toner cartridge for supplying toner to the single developer, a transferrer for applying charges opposite in polarity to the charges of the photosensitive drum to a sheet so that toner defining a developed image on the photosensitive drum is attracted to the sheet, and a cleaner for removing residual toner on the photosensitive drum;

all of the components of the process means are integrated into a single unit which is detachable from the main body;

said single unit being composed of first and second subunits which are separable from each other, said first subunit includes the single developer and the toner cartridge and the second subunit includes the photosensitive drum, the charger, the transferrer, and the cleaner, wherein said toner cartridge is separable from said first subunit said main body has a front cover which can be freely opened and closed, and a storage container attached to an inner surface of said front cover and having an opening for placing items within and removing items from said container.

2. The image recording apparatus as claimed in claim 1, wherein the feeding means include a paper tray for supporting sheets of paper, said paper tray protruding upwardly from the main body, a paper guide for regulating frontal edges of the sheets, a roller for drawing the sheets on the paper tray forward relative to a paper conveyance direction, a separator for drawing one of the sheets toward the process means in association with a pick-up roller.

3. The image recording apparatus as claimed in claim 2, wherein the separator opposes the pick-up roller and extends along an axis direction of the pick-up roller, and the separator has a pick-up plate provided pivotably around a shaft parallel to said axis and a guide member provided also pivotably around said shaft said pick-up plate having a friction member on a surface opposing the pick-up roller.

4. The image recording apparatus as claimed in claim 1, wherein the fixing means include a pressure roller for applying pressure to a sheet, and a heat roller provided in contact with the pressure roller for applying heat and pressure to the sheet.

5. The image recording apparatus as claimed in claim 4, wherein the pressure roller is superimposed on the heat roller.

6. The image recording apparatus as claimed in claim 1, wherein the optical means are disposed in a lower portion of the main body in such a manner as to partially underlie the process means.

7. The image recording apparatus as claimed in claim 1, wherein the optical means are provided integrally in a chassis having an aperture.

8. The image recording apparatus as claimed in claim 7, wherein the chassis is arranged to cover the optical means from above.

9. The image recording apparatus as claimed in claim 1, wherein the optical means are housed in a casing having an aperture.

10. The image recording apparatus as claimed in claim 1, wherein the optical means include a light source unit for emitting light rays, a mirror unit for reflecting the light rays coming from the light source and for allowing the light rays to eventually scan the photosensitive drum, and at least one mirror for reflecting light rays coming from the mirror unit.

11. The image recording apparatus as claimed in claim 10, wherein the mirror unit includes a reflector inclined at 45 degrees relative to a rotational axis of the reflector which is parallel to light rays coming from the light source unit and rotary means for rotating the reflector about the axis, the light rays reflected by the reflector being allowed to eventually scan the photosensitive drum by the rotation of the reflector.

12. The image recording apparatus as claimed in claim 11, wherein a base supporting the reflector is made of resin.

13. The image recording apparatus as claimed in claim 10, wherein the optical means have a plurality of mirrors, among which one mirror is used more than once to reflect light rays coming from different directions on a same side of said one mirror.

14. The image recording apparatus as claimed in claim 11, wherein the optical means have a plurality of mirrors, among which one mirror is used more than once to reflect light rays coming from different directions on a same side of said one mirror.

15. The image recording apparatus as claimed in claim 14, wherein said one mirror is disposed opposite said reflector of the mirror unit and two other mirrors are disposed opposite said one mirror in offset positions.

16. The image recording apparatus as claimed in claim 10, wherein the optical means further include a lens provided opposite the mirror unit for passing light rays coming from the mirror unit, and the light source unit, the mirror unit and the lens are disposed in a casing in an integrated manner with this casing so as to completely close the casing.

17. The image recording apparatus as claimed in claim 1, wherein the delivery tray is provided on the front cover as a single integrated unit.

18. The image recording apparatus as claimed in claim 6, wherein the feeding means include a paper tray for supporting sheets of paper, said paper tray protruding upwardly from the main body, a paper guide for regulating frontal edges of the sheets, a roller for drawing the sheets on the paper tray forward relative to a paper conveyance direction, a separator for drawing one of the sheets toward the process means in association with a pick-up roller; wherein the process means include a photosensitive drum constituted from a conductive body covered with a photoconductive layer, a charger for applying charges to a surface of the photosensitive drum so that an electrostatic latent image is formed on the photosensitive drum when the photosensitive drum is irradiated with light rays emitted from said optical system, a developer for developing the electrostatic latent image on the photosensitive drum with toner, a toner cartridge for supplying toner to the developer, a transferrer for applying charges opposite in polarity to the charges of the photosensitive drum to a sheet so that toner defining a developed image on the photosensitive drum is attracted to the sheet, and a cleaner for removing residual toner on the photosensitive drum; wherein the optical means include a light source unit for emitting light rays, a mirror unit for reflecting the light rays coming from the light source and for allowing the light rays to eventually scan the photosensitive drum, and at least one mirror for reflecting light rays coming from the mirror unit, and wherein the main body has a front cover provided in a manner that the front cover can be freely opened and closed.

* * * * *